US008758566B2

(12) United States Patent
Virtanen et al.

(10) Patent No.: US 8,758,566 B2
(45) Date of Patent: Jun. 24, 2014

(54) PROCESS FOR MANUFACTURING PAPER OR BOARD

(75) Inventors: Pentti Virtanen, Valkeakoski (FI); Sakari Saastamoinen, Hameenlinna (FI)

(73) Assignee: Nordkalk Oy AB, Pargas (FI)

( * ) Notice: Subject to any disclaimer, the term of this patent is extended or adjusted under 35 U.S.C. 154(b) by 0 days.

(21) Appl. No.: 13/701,330

(22) PCT Filed: Jun. 3, 2011

(86) PCT No.: PCT/FI2011/050517

§ 371 (c)(1), (2), (4) Date: Jan. 14, 2013

(87) PCT Pub. No.: WO2011/151525

PCT Pub. Date: Dec. 8, 2011

(65) Prior Publication Data

US 2013/0112360 A1 May 9, 2013

(30) Foreign Application Priority Data

Jun. 3, 2010 (FI) ..... 20105627
Aug. 4, 2010 (FI) ..... 20105835

(51) Int. Cl.
*D21H 17/70* (2006.01)
*D21H 23/00* (2006.01)
*D21H 21/52* (2006.01)

(52) U.S. Cl.
CPC ..... *D21H 17/70* (2013.01); *D21H 23/00* (2013.01); *D21H 21/52* (2013.01)
USPC ..... 162/181.2; 162/141; 162/164.1; 162/168.1; 162/175; 162/183; 162/189; 162/204

(58) Field of Classification Search
CPC ..... D21H 17/67; D21H 17/675; D21H 17/74; D21H 17/28; D21H 17/33; D21H 17/70; D21H 17/73; D21H 21/16; D21H 21/18; D21H 23/10; D21H 23/24; D21C 9/007; D21C 9/004; D21F 1/08
USPC ..... 162/141.142, 147–149, 158, 164.1, 162/168.1–168.3, 175, 181.1–181.8, 162/183–185, 189–191, 204, 207
See application file for complete search history.

(56) References Cited

U.S. PATENT DOCUMENTS 3,898,356 A 8/1975 Williams et al.
4,510,020 A 4/1985 Green et al.
5,096,539 A * 3/1992 Allan ..... 162/9
5,223,090 A 6/1993 Klungness et al.
5,505,819 A * 4/1996 De Witt et al. ..... 162/142
RE35,460 E * 2/1997 Klungness et al. ..... 162/9
5,665,205 A 9/1997 Srivatsa et al.
5,679,220 A 10/1997 Matthew et al.
5,827,398 A * 10/1998 Depasquale et al. ..... 162/164.1
6,387,212 B1 * 5/2002 Christian ..... 162/9
6,540,870 B1 * 4/2003 Laurila-Lumme et al. ..... 162/8
6,592,712 B2 * 7/2003 Koukoulas et al. ..... 162/9
6,599,390 B2 * 7/2003 Rheims et al. ..... 162/9
6,599,391 B2 * 7/2003 Silenius et al. ..... 162/9
6,755,941 B2 * 6/2004 Rheims et al. ..... 162/241
6,881,298 B2 * 4/2005 Rheims et al. ..... 162/9
6,887,351 B1 * 5/2005 Lunden et al. ..... 162/181.2
7,033,428 B2 * 4/2006 Drummond ..... 106/464
8,465,624 B2 * 6/2013 Sealey et al. ..... 162/181.3
2001/0000063 A1 * 3/2001 Silenius et al. ..... 162/181.1
2002/0026989 A1 * 3/2002 Rheims et al. ..... 162/9
2002/0084050 A1 * 7/2002 Silenius et al. ..... 162/181.1
2002/0092636 A1 * 7/2002 Rheims et al. ..... 162/181.4
2002/0148582 A1 * 10/2002 Drummond ..... 162/158
2003/0094252 A1 * 5/2003 Sundar et al. ..... 162/128
2003/0121624 A1 * 7/2003 Rheims et al. ..... 162/9
2003/0150570 A1 * 8/2003 Leino et al. ..... 162/9
2004/0083950 A1 * 5/2004 Nissinen et al. ..... 118/58
2005/0000665 A1 * 1/2005 Doelle ..... 162/9
2005/0121157 A1 6/2005 Doelle et al.
2007/0051480 A1 * 3/2007 Doelle ..... 162/9
2007/0107861 A1 * 5/2007 Doelle et al. ..... 162/9

(Continued)

FOREIGN PATENT DOCUMENTS

CN 102245517 A 11/2011
DE 102 04 254 A1 8/2003

(Continued)

OTHER PUBLICATIONS

International Search Report for PCT Application Serial No. PCT/FI2011/050517 dated Oct. 13, 2011.
Finnish Search Report for Application Serial No. 20105627 dated Mar. 8, 2011.
PCT International Preliminary Report on Patentability for PCT Serial No. PCT/FI2011/050517 dated Jun. 21, 2012.

* cited by examiner (Continued)

*Primary Examiner* — Jose Fortuna

(74) *Attorney, Agent, or Firm* — McCormick, Paulding & Huber LLP

(57) ABSTRACT

The present invention relates to a process for manufacturing paper or board, wherein paper or board pulp is diluted with acidic water and wherein the pH value of the pulp is raised with an alkali simultaneously with increasing the solids content of the pulp by filtration, compression and evaporation on the wire, press and drying sections, and, at the same time, filler is precipitated from the acidic water into the paper or board structure. The invention also relates to moistening of paper or board, with a dry matter content of over 40%, in acidic water, after which the pH value is raised with an alkali, and the paper or board is dried, or it is dried after the moistening without raising the pH value.

22 Claims, 5 Drawing Sheets

(56) References Cited

U.S. PATENT DOCUMENTS

| | | | | |
|---|---|---|---|---|
| 2007/0131360 | A1* | 6/2007 | Sipila et al. | 162/9 |
| 2007/0131361 | A1* | 6/2007 | Doelle et al. | 162/9 |
| 2007/0151681 | A1* | 7/2007 | Doelle | 162/9 |
| 2007/0181275 | A1 | 8/2007 | Ball | |
| 2011/0192921 | A1* | 8/2011 | Virtanen | 241/23 |
| 2011/0233124 | A1* | 9/2011 | Virtanen | 210/198.1 |
| 2013/0062028 | A1* | 3/2013 | Saastamoinen et al. | 162/164.6 |
| 2013/0112360 | A1* | 5/2013 | Virtanen et al. | 162/164.6 |
| 2013/0126116 | A1* | 5/2013 | Solismaa | 162/181.2 |
| 2013/0199745 | A1* | 8/2013 | Virtanen et al. | 162/162 |
| 2013/0333853 | A1* | 12/2013 | Sealy et al. | 162/164.6 |

FOREIGN PATENT DOCUMENTS

| | | | |
|---|---|---|---|
| DE | 10 2006 003 721 | A1 | 1/2007 |
| EP | 0 791 685 | A2 | 8/1997 |
| EP | 1 152 086 | A2 | 11/2001 |
| FI | 20085969 | A | 4/2010 |
| FI | 20096098 | A | 4/2011 |
| WO | 03/033815 | A2 | 4/2003 |
| WO | WO 2010043768 | A1 * | 4/2010 |
| WO | 2011/131843 | A1 | 10/2011 |
| WO | 2011/151525 | A1 | 12/2011 |

PROCESS FOR MANUFACTURING PAPER OR BOARD

CROSS REFERENCE TO RELATED APPLICATIONS

This application is entitled to the benefit of and incorporates by reference essential subject matter disclosed in International Patent Application No. PCT/FI2011/050517 filed on Jun. 3, 2011 and Finnish Patent Application No. 20105627 filed Jun. 3, 2010 and Finnish Patent Application No. 20105835 filed Aug. 4, 2010.

TECHNICAL FIELD

The present invention relates to a process for manufacturing paper or board from paper or board pulp, respectively.

According to such a process, a solids-bearing slush is brought into contact with a water-based composition which comprises forms of carbonate, along with calcium and/or magnesium ions, in conditions which are suitable for the manufacturing of paper or board products. Typically, the pH value of such a composition is lower than 8.3.

The present invention also relates to an alternative process, according to which almost dry paper or board is treated with this acidic water-based composition.

BACKGROUND

It is known that in paper production the paper or board product is generated by removing water from the solids slush. The quantity of water is clearly the largest of the raw materials and the aim is to remove it as rapidly as possible from the finished product (uncoated or coated paper or board) by using a wire, a press and a drying section. Typically, in paper production "high consistency pulp" is first generated mainly from fibres, water and inorganic fillers or pigments. The high consistency pulp is diluted (typically to a consistency of 0.2-1.5%) in order to achieve better quality properties, before the pulp is spread from the headbox and before the dewatering is started in the wire section.

The process of dewatering and the attachment of detrimental substances to the fibres are among the most important factors affecting the economy of paper production, and it is attempted to affect these chemically, among others, using various flocculants and coagulants. Mechanically, it is attempted to affect the dewatering at the wire, press and drying sections (in the wire section for instance by means of suction boxes and drainage foils, which are designed to accelerate the dewatering by means of pulsation). More effective dewatering also reduces energy consumption needed for drying in the drying section.

Over decades, the wire sections of paper and board machines have changed considerably. Earlier, in Fourdrinier machines, water was removed only through one wire. In modern gap formers, water is removed simultaneously through two wires. After the wire section, the dry matter percentage of paper or board is generally 15-25%. At this stage, the water lies mainly between the fibres. The remainder of the water is mainly in the lumens of the fibres, the pores and the walls of the fibres.

In the press section, it is possible to raise the dry matter percentage to as high as approximately 50%. The most important task of the press section is to increase the tensile strength of paper or board in order to improve the runnability of the machine. In the drying section, the remaining water, which is mainly in the lumens of the fibres, the pores and the walls of the fibres, is evaporated. The percentage of dry matter is generally increased from 35-45% to approximately 95%.

Paper is generated from the pulp, which can be either mechanical pulp or chemical pulp, or recycled fibre pulp.

Here, mechanical pulps mean groundwood pulp, refiner groundwood pulp, thermomechanical pulp (TMP), pressure groundwood (PGW) and chemi-mechanical pulp (CTMP). Chemical pulp is pulp which is prepared from cooked wood chips. Recycled fibre may be deinked (DIP) or undeinked (for instance OCC). The most typical deinking methods are wash deinking, enzymatic deinking, flotation, and combinations of these three. The essential difference between these various pulps is that the mechanical and chemical pulps are made from "virgin" fibres, i.e. fibre from which paper or board has not yet been manufactured. Recycled fibre, in turn, is made from finished paper or board by recycling it for production of a new paper or board product. The pulps can be bleached or unbleached. The most typical bleaching methods are peroxide bleaching and dithionite bleaching.

In the production of chemical pulp, mechanical pulp and recycled fibre pulp, various wood-based and other dissolved and colloidal substances are released into the process waters. In mechanical pulps, dissolved and colloidal substance means mainly wood-based soluble and colloidal compounds (hemicelluloses, lipophilic extractives and compounds such as lignin), particularly resin. Resin is sourced from wood and comprises various fatty acids, esters, resin acids and sterols. The soluble and colloidal materials which accompany the recycled fibre and which are detrimental to the production of paper and board, are generally called gunges. A dissolved and colloidal substance is called a detrimental substance because it increases the consumption of chemicals, is generally very small-sized, anionic and easily generates precipitates. Typically, the gunges are thermoplastic impurities such as glue, latex, waxes, printing inks, anti-foaming agents and plastic. The gunges may include for instance compounds such as vinyl acetate, polyamides, polyethylene, polybutadiene, caoutchouc and styrene acrylate. The gunges may also comprise residues of beater-sizing (AKD, ASA and resin gluing), wood-based dissolved and colloidal substance and resin. Both resin and the gunges are hydrophobic. They have a tendency to agglomerate in water into large precipitates. This agglomeration is encouraged by variations in pH and temperature, and strong shear forces. In paper and board machines, the gunges stick to metal surfaces, wires and felts. Over time, they may also accumulate in the piping of the white water system and then unpredictably break free, thereby causing numerous breaks in the wet section, press section and drying section. On the wires and felts, they can reduce the water drain and thus the productivity of the paper or board machine. Dark hydrophobic precipitates also reduce the level of brightness, because in water they attract components of wood, such as tannins, which readily attach to them. In a final paper or board, these may be visible as dark patches. Typically, for paper and board machines in which it is not possible to efficiently keep low in the circulating water the amounts of dissolved and colloidal substance which accompany especially mechanical pulp or recycled fibre, shutdowns for cleaning must be arranged frequently because to avoid quality and runnability problems. In some production processes of mechanical pulp or recycled fibre, the fibres are additionally bleached with hydrogen peroxide or dithionite. Peroxide bleaching in particular substantially increases the amount of dissolved and colloidal detrimental substance in the waters of paper and board machines.

Typical chemical methods of removing the detrimental effects of hydrophobic substance are stabilisation, i.e. dispersing of the hydrophobic substance, attachment to the fibre and adsorbing to an active surface. To reduce the amounts of hydrophobic detrimental substance, they are dispersed, in which case their agglomeration is prevented. The problem with this is that over time the percentages of the hydrophobic substances may grow to the extent that the paper or board machine suffers from runnability problems. Preferably, the hydrophobic substance is attached, preferably small-sized, to the fibre, and removed from the process along with the finished paper or board. Adsorbing the hydrophobic substance onto an active surface prevents agglomeration and adherence to the surfaces. Minerals such as talc and bentonite are used for this. Here, it is important to remove the minerals from the process by means of good wire retention, otherwise the runnability problems will recur, for instance when the dispersion method is used. The most reliable method is, and this is achieved by attaching the hydrophobic substance to the fibres, to remove the hydrophobic substance as close as possible to the point where the hydrophobic substance enters the white water system of the paper or board machine. This is the purpose of the invention of the application.

By using different screens and cleaners which employ centrifugal force, the largest agglomerates of hydrophobic substance are removed mechanically—often before a chemical treatment. It is also possible to use combinations of all of the above-mentioned means. The surfaces of paper or board machines, on which surfaces most of the precipitates accumulate, are generally treated with different chemicals, in which case attachment of precipitates onto the surfaces are prevented. Examples of such chemicals are organic solvents, acids and alkalis.

By storing the raw wood and also by applying certain enzyme treatments it is also possible to reduce the detrimental effects of hydrophobic substance. It is also important to separate the circulating waters of the pulp production from the white water system of the paper or board machine, in which case it is possible that part of the hydrophobic substance left inside the pulp production. In fact, nowadays this is the usual way in most paper and board mills. Also, a carefully designed and executed wash program of the white water system of a paper or board machine, used in conjunction with effective use of biocides prevents problems which are caused by dissolved and colloidal substance. A lot of air and foam in the pulp also increases problems caused by the hydrophobic substance.

The process water is the dilution water of the consistent pulp obtained from the production of mechanical pulp (for instance at a groundwood mill and refinery) or the production of recycled fibre (for instance at a deinking plant), and which water is taken from the white water system of the paper or board machine. The process water used is often circulating water having a low consistency. Consistent pulp in the production of the different pulps mentioned above is often concentrated by mechanical means, to avoid the waters of the pulp production being carried into the white water system of the paper or board machine. In this stage, the consistent pulp is called a high-consistency pulp, because its consistency generally exceeds 8%. Often, the high-consistency pulp is moved to the storage tower of the paper or board mill, from which it is diluted with fetch waters for further use in the production process of paper or board. In the present application, the water-based composition which is formed of colloidal carbonate particles and bicarbonates and other forms of carbonate (the pH value remaining essentially between 6.0 and 8.3), and which is prepared into the fetch water, is called acidic water.

In order to attach the hydrophobic soluble colloidal substance to the fibre it is advantageous that the so called acidic water is brought to react with a pulp which has as high a consistency as possible, at the earliest possible stage, in the white water system of the paper or board machine. The first point at which the chemical pulp or the mechanical pulp or the pulp coming from the production of recycled fibre enters the white water system of the paper or board machine is the containers for storing the consistent pulp, from which containers the pulp is moved forward, having been diluted with fetch water, to the paper or board production process.

The aim is to affect the economy and quality of the production of the paper and board by using different mineral fillers. These improve the quality properties, particularly opacity, brightness and printability. They often improve the economy because they are cheaper than fibre and they bind water to themselves less than fibre does. A lower water adsorption capacity is expressed in the wire, press and drying sections as faster dewatering, which in turn lowers energy costs in the drying stage.

Paper qualities such as copying papers and certain magazine papers, the filler percentages of which are large, generally require greater rigidity. The demand for lower grammages in the production of paper and board also places a premium on rigidity. Generally, the rigidity of paper declines as amount of filler in the paper rises or when the grammage is lowered. In fact, this reduction of rigidity and the lower strength together present the most important quality challenges when using fillers.

For instance, the following mineral fillers (or coating pigments) can be included are examples of the fillers used: kaolin, titanium dioxide, gypsum, talc, ground calcium carbonate (GCC), precipitated calcium carbonate (PCC) and satin white. The most used fillers are GCC, PCC and kaolin.

The reduction in strength and rigidity of paper and board products that occurs when fibre is replaced with a filler is mainly caused by fillers decreasing the generation of hydrogen bonds between fibres, because the surface of the fillers do not form hydrogen bonds.

Nowadays, the filler is directly added into the fibre slush. In the wire section, only part of the filler added is attached to the finished paper or board web. The rest of the filler is carried through the white water system to ultimately form part of the finished paper or board structure, but in that case the risks of different runnability problems increase, mainly because of attachment of different hydrophobic substances to the fillers in the white water system. Generally, the resulting runnability problems appear in the paper or board machine for instance as fouling of the wires and felts, i.e. breaks. Part of the filler in the white water system also eventually overloads the sewage treatment plant, because the filler never travels out from the process along with the finished paper or board.

Because of the several disadvantages mentioned above, patents have been applied for during the last two decades, which patents are particularly related to precipitation of calcium carbonate directly into the fibre structure in the production process of paper or board. The aim of these known solutions is mostly to precipitate calcium carbonate either into the fibre structure or into its lumen.

Numerous such patents exist which relate to the precipitation of calcium carbonate directly into the fibre structure during the production process of a paper or board mill, and it is not appropriate to go through all of them here one by one. However, in the following, we refer briefly to a few interesting publications.

U.S. Pat. No. 4,510,020 is a patent related to the process of precipitating into the fibre lumens. According to the publication, powerful mixing is used to force precipitated calcium carbonate particles inside the lumens of fibre. The calcium carbonate particles which adhere to the outer surfaces of the fibres are detached from the surface of the fibres during the washing stages which follow the mixing. The calcium carbonate particles are detached more rapidly from the surface of the fibres than from inside the lumens, in which case the result is an outer surface of fibre which generates hydrogen bonds, and a fibrous structure, the brightness, the opacity and the rigidity of which are better.

U.S. Pat. No. 5,223,090 describes how calcium oxide or calcium hydroxide is mixed among fibres using high shear speed mixing, while carbon dioxide is simultaneously fed into the mixer.

WO published patent application 03033815 A2 describes how precipitated calcium carbonate is precipitated into a diluted fibre pulp, and onto the surface of the fibres, by using in this precipitation calcium carbonate slurry which is partly dissolved to calcium bicarbonate, and calcium hydroxide, or calcium hydroxide and carbon dioxide.

EP publication 0791685 A2 describes the precipitation of calcium carbonate onto the surfaces of fibre and fines by means of adding carbon dioxide into a mixture of calcium hydroxide and fibre material. As a final result, on average, 500 nanometer calcium carbonate crystals are precipitated onto the surfaces of the fibre.

In general, for reasons of cost or technical reasons these solutions have not been put into practice.

Water-based compositions and how they are used in the production of paper and board are described in FI publication 20085969, FI application 20096098, FI application 20105437 and FI application 20105627. These publications demonstrate that by using a composition which comprises forms of carbonate and calcium and/or magnesium ions it is possible to achieve good adhesion of a filler to the fibrous web, rapid dewatering, the attachment of hydrophobic particles to the fibrous web, and also improved opacity, rigidity and printability of the finished paper or board.

In particular, FI publication 20085969 demonstrates that by means of colloidal calcium carbonate and bicarbonate, and aqueous solutions of other forms of carbonate, an improved dewatering, retention and formation are achieved in the production of paper, within the pH range of 6-9, when a charged polymer is used. According to this published method, burnt lime or calcium hydroxide is first added into the process waters, after which the pH value is lowered, by applying carbon dioxide, to the range of 6-9. This sequence of addition, which is described both in the examples and the claims of the publication, and in particular the fact that the pH value is measured only after the addition of the other components, leads to pH variations in the solution during the production. It is known that variation in pH is a factor which causes agglomeration of hydrophobic detrimental substance. However, the publication makes no mention of any addition of a charged polymer and/or inorganic chemical either into the process water of a paper or board mill prior to the preparation of the acidic water, or into the water-based composition (acidic water) before diluting the pulp.

FI application 20096098 is similar to the previous publication except in that the lowest percentage of the colloidal calcium carbonate and bicarbonate and other forms of carbonate is lowered more than in FI publication 20085969. However, also in this application, charged polymer and/or inorganic chemical is not added into the process water of a paper or board mill prior to the preparation of the acidic water, nor into the water-based composition (acidic water) before diluting the pulp.

FI application 20105437 differs from the preceding publications in that the pH variations in the colloidal calcium carbonate and bicarbonate, and other forms of carbonate are removed during the production. However, in the application, it is still a fact that the waters of the paper or board machine, which waters are changed into water-based compositions, according to the application, are directly used for diluting the paper or board pulps—charged polymers and/or inorganic chemicals are not added into the process water of the paper or board mill prior to the preparation of the acidic water, nor into the water-based composition (acidic water) before diluting the pulp.

SUMMARY

The purpose of the present invention is to solve the problems associated with the prior art.

A particular purpose of the present invention is to attach the soluble and colloidal detrimental substance which passes from the production stage of chemical pulp, mechanical pulp and recycled fibre to the fibre already at the stage where the high-consistency pulps (consistency>8%) of the paper or board mill are diluted. This attaching is carried out by diluting the said pulp with search waters, which are prepared to form "acidic" water.

Another particular purpose of the present invention is to attach the hydrophobic detrimental substances to the fibre in such a way that it is possible to remove them from the paper or board production process along with the final product (i.e. the paper or board).

An additional purpose of the present invention is to generate a novel solution for integrating carbonate compounds into the fibre pulp in such a way that the water-based composition that is used further improves the rigidity, the brightness and the opacity, especially in the production of paper and board products.

By raising the pH value of the slush with an alkali and simultaneously increasing the solids percentage of the pulp by filtration, compression and evaporation in the wire, press and drying sections respectively, it is possible to efficiently integrate the filler into the fibre product. Carbonate filler brings opacity, brightness, printability, thickness and rigidity to the fibre structure.

Furthermore, the present invention has demonstrated that when a finished or nearly dry paper or board is moistened in acidic water, either directly after the drying or, alternatively, after increasing the pH value with an alkali and subsequent drying, improvements in the brightness, opacity, thickness and rigidity are achieved. This moistening can be either a separate moistening process for instance carried out before the paper is coated, or as a part of the process and carried out for instance during the surface sizing.

Thus, the present invention relates to a process for manufacturing paper or board from paper or board pulp, according to which process the pulp is diluted with acidic water.

"Acidic water" here means a water-based composition which is generated from forms of carbonate and counter-ions, at a pH value which is lower than 8.3.

The present invention can be utilised, among others, in the production of paper and board types, examples of which are listed below: soft tissue, newsprint, coated fine paper, magazine paper, copying paper, fine paper, label paper, sack paper, corrugated boards, chipboard, core board, boxboard, coated mechanical papers, wrapping papers and wall base paper.

More specifically, the process for manufacturing paper or board products, according to the present invention, is such that forming the water-based composition of colloidal carbonate particles and bicarbonates and other forms of carbonate into process water, or a mixture of this process water and pure water, at a pH value of less than 8.3, and raising the pH value of the pulp with an alkali after the dilution, simultaneously with increasing the solids content of the pulp in order to precipitate a carbonate filler from the water-based composition into the paper or board structure.

An alternative process according to the present invention is, in turn, such that almost dry paper or board is moistened in a water-based composition, which is formed of colloidal carbonate particles and bicarbonates and other forms of carbonate into process water at a pH value of less than 8.3, after which the pH value is raised with an alkali, and the paper or board is dried.

Considerable advantages are achieved with the present invention. Thus, the invention enables rapid dewatering and a simultaneous improvement of the brightness, opacity, printability, thickness and rigidity of paper or board by increasing the pH value, by using an alkali, of the paper or board pulp, which is diluted with a water-based composition.

Dewatering can be made more efficient by attaching the detrimental substances to the fibre.

A soluble substance, especially a hydrophobic detrimental substance, which is brought in by chemical pulp, mechanical pulp or recycled fibre, is removed with the so called acidic water from the white water system of the paper or board machine. The effect of the acidic water in removing the hydrophobic substance is preferably intensified by using one or several charged polymers and/or inorganic chemicals, such as bentonite or talc. It is essential that the acidic water is prepared into the process water of the paper or board machine, with which water the chemical pulp, mechanical pulp or the pulp coming from the production of recycled fibre is diluted into the white water system of the paper or board machine.

The present invention both improves the quality properties of paper and board, and also the economy of the production process. According to the present invention, a soluble colloidal detrimental substance, particularly a hydrophobic substance, which is brought in by the chemical pulp, mechanical pulp or recycled fibre, is attached to the chemical fibre, mechanical fibre and the recycled fibre at the earliest possible stage, as the production process of paper or board is approached. The present invention makes it simpler to manufacture paper and board by reducing the quantity of the chemicals needed. The economy of paper production can be improved and the costs of chemicals considerably reduced by using the water-based composition according to the present invention. The savings are a result of both reduced costs of chemicals and of reduced number of wash shutdown days, the number of breaks and fewer problems associated with the quality of paper and board (for instance holes and patches).

FI application 20105437 demonstrates that it is possible to increase the opacity, printability and rigidity of finished paper or board. The present invention offers the possibility to control the precipitation of carbonate filler by increasing the pH value with an alkali, and simultaneously removing water from the slush in the wire and press sections. Dewatering is thus maximised, and, at the same time, the costs of the paper or board machine kept to a minimum, both without reducing the quality properties. In other words, from the water-based composition which enters the surface of the fibre network, carbonate filler is precipitated into the fibre structure and, at the same time, water is allowed to exit into the recirculation of white water. It would be necessary to drive the web in a very wet condition through the wire and press sections if heat alone enabled carbonate filler to precipitate from acidic water into the fibre network, in order to precipitate an adequate amount of calcium carbonate into the paper or board, to achieve the needed opacity, rigidity, printability and brightness targets.

The above mentioned references describe the advantages of a water-based composition, i.e. acidic water, in preventing precipitates forming in the piping leading up to the headbox and the white water system. In addition, in the wire section a faster dewatering and better retention to the wire have been observed. By combining these advantages with the attachment of carbonate filler to the paper or board structure, as described in the present invention, which attachment is achieved as a result of the ions of the acidic water by raising the pH value, and also by drying, not only are the quality properties associated with thickness, opacity and brightness achieved but also, for instance the following potential advantages:

A) It is possible to decrease the consistency in the headbox, because it is not necessary to add filler into the paper or board pulp, because the carbonate filler, which is formed from acidic water, replaces part of the filler which would otherwise be added. Ideally, no filler need be added. When the consistency in the headbox is lowered, a better formation is also achieved.

B) The smaller the amount of filler added, the better the generation of hydrogen bonds between the fibres, which helps to improve the strength.

If no fillers are needed, which fillers are used mainly to achieve the opacity, brightness and printability targets, it is possible, in addition to the above mentioned advantages, to achieve the following additional advantages:

C) If it is possible to keep the pH value of the circulation water on the acidic side (particularly if there is no need to add GCC or PCC), a better runnability of the paper or board machine is achieved, due to less microbiological growth.

D) Almost no fillers from the wire end up in the circulation water, in which case the number of problems associated with precipitation is reduced.

E) Simultaneous raising of the pH value and the percentage of solids in the pulp in the wire, press and drying sections can result in a strong middle layer in the paper or board, and lead the carbonate fillers, which are precipitated from the water-based composition, onto the surfaces of the paper or board structure. By this means, it may be possible to achieve the same properties as are achieved with multi-layer headboxes.

In the following, the present invention will be examined in more detail with the help of drawings, a detailed explanation and a few examples.

BRIEF DESCRIPTION OF THE DRAWINGS

Other advantages which are achieved with the present invention are presented in the examples described below. With respect to these examples.

DETAILED DESCRIPTION

Figure 1:
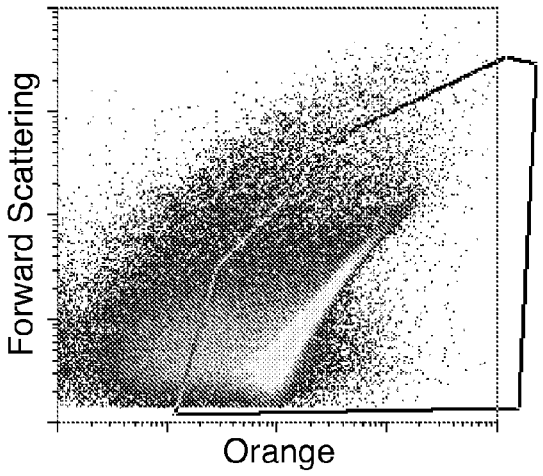
FIG. 1 shows a "gate", which demonstrates how hydrophobic particles are separated from the other particles.

The present invention relates to a process for manufacturing paper or board from paper or board pulp, according to which process the pulp is diluted with acidic water, particularly in such a way that the pH value of the pulp is raised with an alkali, and simultaneously the solids percentage of the pulp is increased, in order to precipitate the carbonate filler from the acidic water into the paper or board structure.

According to an embodiment, the invention relates to manufacturing paper, board and similar fibre products by using a paper or board machine. Typically, in a paper or board machine, the paper, board or corresponding pulp (fibrous substance) is slushed, primarily to a consistency of 0.1-2% by weight, fillers and possible additives are then added into the slush, and the slush generated is spread onto the wire and dried by removing the water especially by filtration, compression and evaporation. The measures are generally carried out respectively in the wire, press and drying sections of the paper or board machine.

In this embodiment, solids-bearing slush, such as paper or board slush, is manufactured by dilution using a water-based composition. Consequently, attachment of the hydrophobic particles to the fibrous web, maximum retention to the wire, and rapid dewatering in the wire section, are ensured. The aim is that as a result of the calcium and/or magnesium ions of the water-based composition and as a result of the bicarbonate, carbonate filler is precipitated into the fibre structure, before or after the press section. This precipitation is carried out by raising the pH value of the paper slush with an alkali and by drying the paper in the drying section. The generation of precipitation is possible also by applying only drying. The purpose is to generate a desired quantity and distribution of precipitated carbonate filler in the fibre structure by adjusting the dewatering in the wire and press sections and thereby adjusting the dry matter of the fibre web before and after the press section.

The dewatering can be adjusted also by attaching a hydrophobic detrimental substance to the fibre.

This soluble and colloidal substance, i.e. detrimental substance, can be removed from the pulp which comes from the production of chemical pulp, mechanical pulp or recycled fibre in such a way that this consistent pulp is diluted with a water-based composition which is prepared into the "search water" of the paper or board machine and which comprises colloidal-sized carbonate particles, bicarbonate ions and other forms of carbonate in an aqueous solution, in such a way that the pH value of the aqueous solution remains essentially within the range of 6.0-8.3, and the consistency after the dilution is at least 1.5%.

In the present invention, "colloidal carbonate particle" means different forms of carbonate (for instance $CO_3^{2-}$ and $HCO_3^-$), which have a small average particle size, under 300 nm, preferably under 100 nm. Preferably, the carbonate is calcium carbonate, and the percentage of its addition is preferably at least 0.01%, for instance 0.01-5%, especially 0.01-3%, calculated from the weight of the solids of the pulp.

The attachment of the soluble and colloidal substance, especially the hydrophobic particles, which come from the production of chemical pulp, mechanical pulp or recycled fibre, to the fibre can be controlled with cationic coagulant polymers, which are generally very short-chained, but which possess a high density of cationic electric charge. Examples of these cationic coagulant polymers are starch, polyamines, polydadmacs, polyethylene imines, polyacrylamides, polyvinylamines and copolymers or terpolymers of them. Water solubles which comprise aluminium, such as aluminium sulphate, i.e. alum and polyaluminium chloride, bring a cationic charge to the circulating waters and thus facilitate the attachment of hydrophobic substance to the fibre. The ability of different inorganic minerals, such as bentonite and talc, to remove hydrophobic particles from circulating waters is based on their low hydrophobicity.

The present invention is thus especially related to a process in which chemical pulp, mechanical pulp or recycled fibre pulp is diluted with a water-based composition, which is generated into an aqueous solution, particularly from colloidal-sized carbonate and bicarbonate particles and other forms of carbonate in an aqueous solution, in such a way that the pH value of the aqueous solution remains during this generation of the aqueous solution within the range of 6.0-8.3, and, in particular, hydrophobic disturbing substance is attached to the fibre before the water is removed from the pulp by means of filtration, compression and drying.

According to the present invention it is preferred that electrically charged polymer and/or inorganic chemical is added into the water for the preparation of the water-based composition or into the water-based composition before the consistent mechanical pulp, chemical pulp or deinked recycled fibre pulp is diluted.

According to a preferred embodiment of the present invention, chemical, mechanical or recycled fibre pulp is first diluted with a water-based composition, after which one or more charged polymers and/or inorganic chemicals are added, and the ingredients are allowed to react with each other before the water is removed from the pulp. During the dilution, the aim is to keep the consistency as high as possible in order to attach as much as possible of the soluble and colloidal disturbing substance to the fibre.

Another possibility is to use acidic water, according to the present invention, in the wash sprays of the wires and the felts, together with or separate from various charged polymers or inorganic substances. The purpose is to prevent fouling, caused by precipitates, of the felts, wires and other parts of the paper or board machines.

According to a particularly preferred embodiment of the present invention, a chemical pulp, mechanical pulp or recycled fibre pulp which is diluted with the water-based composition mentioned above works together with one or more charged polymers and/or inorganic chemicals in such a way that they are dosed into the slush or pulp at one point or at several points in the white water system of a paper or board machine. The polymers used for this purpose can be natural polymers or synthetic polymers.

The charged polymers utilized in the present invention are natural polymer, synthetic polymer, copolymer or a mixture of these, especially cationic polyacrylamide, polyethylene imine, starch, polydadmac, polyacrylamide, polyamine, starch-based coagulant, copolymers of any of these, or a mixture of two or more of such a polymer or copolymer. The most preferable charged polymer is polydadmac, polyamine, polyacrylamide or a copolymer or a terpolymer of two or more of these.

Inorganic chemicals which are utlilised in the present invention are, in turn, for example surface-active agents, anionic polymers, a copolymer of anionic and a hydrophobic polymer, talc, alum, polyaluminium chloride, bentonite, starch, gelatin and some other proteins and very cationic polymers. Typically, highly charged cationic polymers are more short-chained than those less charged. Highly charged polymers are generally called coagulants or fixatives, because their purpose is to lower the anionic charge level of the dissolved and colloidal substance and to attach the hydrophobic substance to the fibres. Examples of these cationic polymers are polyacrylamide, polyethylene imine, starch, polydadmac, polyamine, polyethylene oxide, polyvinylamide, dicyanamide, a copolymer or terpolymer of any of the above, or a mixture of any of them.

Besides the above-mentioned, it is also possible to dose other polymers into the paper pulp, in different steps at a stage of the paper or board production process which follows the dilution with a water-based composition.

Together with the water-based composition, the polymers generate improvements in several sub-stages of the paper or board production, such as in the stages in which the hydrophobic substance is attached to the fibre. However, to achieve the best possible effects it is also important that there are ion-formed carbonates (especially bicarbonates), together with colloidal calcium carbonate, in the aqueous solution.

According to a preferred embodiment of the present invention, also a compound which comprises water-soluble aluminium is dosed into a water-based composition or into pulp which is diluted with this composition.

In an ideal paper or board structure, the fillers are near the surfaces, and a strong and rigid middle layer is formed of hydrogen bonds, with no filler to reduce the strength and rigidity. By using an alkali, the aim is to precipitate carbonate filler into the fibre structure without preventing dewatering in the wire section. Paper slush, which is diluted with a composition according to the present invention, can comprise fillers or coated broke which are mixed with the fibres before it enters the headbox, but these are not necessary. In a preferred embodiment, essentially no coated broke nor filler is added into the paper or board pulp.

The present invention has multiple functions and improves several properties: it improves the quality properties of paper and board, and also the economy of the production process. For example, the present invention does away with the need to mix the filler into the fibre slush before it enters the headbox, and still it is possible to replace fibre with filler, which gives opacity, brightness and printability in places where they are needed, i.e. in the structure of the finished paper or board.

At the same time, filler is prevented from entering the white water system, which entering occurs because of poor retention of the filler. Improving the structural strength of the paper or board by increasing the rigidity and the thickness (bulk) is achieved by the presence of a strong middle layer.

In the present invention, the fibres can be chemical cellulose pulp or mechanical pulp. Recycled fibre can also be used. For instance, sulphate and sulphite pulp fibres, dissolving pulp, nanopulp, chemi-mechanical pressure pulp (CTMP), thermo-mechanical pulp (TMP), pressure groundwood (PGW) pulp, mechanical pulp, recycled fibre or fibres from deinked pulp, can form the solids. Typically, sulphate and sulphite pulp are called chemical pulps, whereas thermomechanical pulp, pressure groundwood pulp and mechanical pulp are called mechanical pulps.

All the chemicals which are used in the production of paper and board can also be used in paper production according to the present invention, such as beater adhesives, surface adhesives, flocculants, coagulants, antislime agents, optical brighteners, plastic pigments, colours, aluminium compounds, wet strength adhesives, dispersants, anti-foaming agents, starch, bleaching agents etc.

Furthermore, it is possible to use aluminium compounds, charged natural polymers, charged synthetic polymers, and bentonite, talc etc.

In the present invention, it is possible to use various chemicals to improve the productivity of the paper or board machine and the quality of the product manufactured. The purpose is either to affect advantageously, by means of different chemicals, the economy of the process or to improve a particular important quality property during the production of paper or board. In this case, unwanted reactions between different chemicals often take place. The use of different chemicals easily generates chemical residues in the white water system, which residues can appear as precipitates and gunges, and other runnability problems in the production of paper and board. Very few, if any, chemicals generate many improvements both in the production process and in the quality of the product. However, the present invention improves several properties, such as quality properties of paper and board, and also the economy of the production process.

Thus, besides these optional chemicals, the present invention utilizes a water-based composition, which is generated from forms of carbonate and from calcium ions and/or magnesium ions at a pH value which is lower than 8.3. These forms of carbonate can be, among others, colloidal-sized carbonate particles (calcium and/or magnesium), bicarbonate ions, carbonate ions, carbonic acid and other forms of carbonate in an aqueous solution at a pH value which is lower than 8.3, for instance 6.0-8.3, at a percentage of at minimum 0.01%, for instance 0.01-5%, preferably 0.01-3%, calculated from the solids weight. Such a water-based composition is hereinafter called "acidic water" in the present application.

When such a composition is used in paper or board production, the fibre pulp is totally or partly diluted by using this composition.

That or a corresponding composition is preferably prepared by adding oxide or hydroxide slurry, most suitably in the form of calcium oxide or calcium hydroxide slurry, and, simultaneously, carbon dioxide, into a flowing aqueous solution in such a way that the pH value of the solution remains lower than 8.3, preferably at a value between 6.0 and 8.3.

According to a preferred embodiment, the quantity of the oxide or hydroxide added is such that the resulting percentage is at least 0.01%, for instance approximately 0.01-5%, preferably approximately 0.01-3%, calculated from the weight of the solids of the final pulp.

With this composition, a paper or board product is generated which comprises at least solids from said water-based composition, and fibre.

In the production of the water-based composition, it is essential that the pH value of the composition is kept constant in the production stage and the raw material used is a flowing aqueous solution, the pH value of which remains within the range of 6-8.3. In this way, fluctuations of the pH value are avoided when the composition is added into the pulp. In paper or board production, large fluctuations in the pH value easily result in the generation of precipitates and also runnability problems. In a mechanical pulp, an alkaline pH range also causes darkening of the pulp. This can be noticed for instance when wire water which comprises fines is being handled.

The hydrocarbonate of acidic water degrades when it is heated, when the pH value is raised or the pressure is increased, thereby causing it to react with calcium ions (or magnesium ions). In this case, calcium carbonate (magnesium carbonate), carbon dioxide and water are generated, according to the following reaction formula:

$$Ca^{2+}+(HCO_3^-)_2 \rightarrow CaCO_3\downarrow+CO_2\uparrow+H_2O\uparrow.$$

One of the most important systems for buffering the pH of water relates to the chemistry of carbonate ions. This is critically important for paper or board machines, the targeted pH value of the white water system of which is maintained at a pseudoneutral or neutral level. A pH value range of 6-8 is typical in modern paper and board machines. The most important reason for choosing this pH value range is the use of carbonate fillers and coating pigments carried in by coated broke, and often a faster dewatering, which is achieved within this pH value range.

Here, carbonate system means altering of carbonate forms according to the pH value. The main forms of carbonate are the following:

$$H_2CO_3 \leftrightarrow HCO_3 \leftrightarrow CO_3^2$$

Within the acidic pH range, the main forms of carbonate are soluble carbon dioxide ($CO_2$) and, to a minor extent, carbonic acid ($H_2CO_3$). Within the neutral (both sides of pH value 7) and the alkaline range, bicarbonate, i.e. hydrocarbonate ($HCO_3^-$) is the main form of carbonate, even up to a pH value of approximately 10. Within the very alkaline range (pH value>10), carbonate ($CO_3^{2-}$) is the main form. When moving from the alkaline range towards the acidic range, essentially all of the $CO_3^{2-}$ is transformed into the form of $HCO_3^-$ at a pH value of approximately 8.3. Consequently, within the pH range of 6-8, which is the most important range to paper and board production, bicarbonate ($HCO_3^-$) is the most prevailing form.

Calcium carbonate fillers and pigments are calcium salts of carbon acid, which salts are generally known in the paper and board industry as ground calcium carbonate (GCC) or precipitated calcium carbonates (PCC). Traditionally, the aim is to keep the average particle size of these salts bigger than 500 nanometers, typically 1-2 micrometers, because in this case it is believed that the best possible light-scattering properties (brightness and opacity) are achieved. The solubility in water of these particles is very limited in normal conditions. One of the reasons for using the calcium carbonate fillers and pigments is to replace fibre, which is often more expensive, in the finished paper or board. However, in acidic conditions, soluble calcium ions, which increase the hardness of water, are released from calcium carbonate. Lowering the pH value from 8 to 7 may cause a hundred-fold increase in the number of dissolved $Ca^{2+}$ ions. Typically, the aim is to keep the pH value of the carbonate slurry at approximately 8, if not higher, in order to prevent such dissolving, which is detrimental to the structure of the fillers and pigments. In this case, also the greatest advantages of the present invention in the production of paper and board are lost as a result of a decrease in the significance of bicarbonate ($HCO_3^-$) and colloidal calcium carbonate particles.

In fact, in the present invention, we have found that if there is dissolved carbon dioxide in the water, the calcium carbonate dissolves and changes its form to calcium bicarbonate. Consequently, it is found advantageous to treat the fetch waters of the paper or board machine either with burnt calcium oxide (CaO) or calcium hydroxide ($Ca(OH)_2$) and to add carbon dioxide ($CO_2$) into the process waters, in which case advantages are gained when the dissolved and colloidal, especially hydrophobic, substances carried in during the production of chemical pulp, mechanical pulp or recycled fibre, are removed along with the finished product, from the paper or board production.

It is essential that almost fibre-free water is used when oxide or hydroxide, such as calcium hydroxide, or a mixture of these is added into the fetch water. The amount of addition of these oxides or hydroxides or mixtures of them, which are added simultaneously along with carbon dioxide, is such that the pH value of the aqueous composition is maintained within the range of 6.0-8.3. In this case, it is possible to generate an aqueous solution of a colloidal-sized carbonate compound (the average particle size being smaller than 300 nm, preferably smaller than 100 nm) and a bicarbonate compound, and also to minimise the effect of the carbonate ($CO_3^{2-}$) ion.

The process water to be treated is preferably raw water, chemically purified water, mechanically purified water, wire water, filtrate water which is purified to different purity grades, or another water which is used at a paper or board mill, or a mixture of one or more of the above.

According to the above, variations in the pH value cause, among others, precipitates, for instance $CaCO_3$ particles, which can be elementary particle-sized (smaller than 10 nanometers) are precipitated from $Ca(HCO_3)_2$. By minimizing the pH variations in the stage of manufacturing the water-based composition according to the present invention, the generation of possible detrimental precipitates and runnability problems are prevented, and the fall in the brightness that occurs in the alkaline pH range, which is typical of mechanical pulp, is lessened. Generally, the runnability problems in paper or board machines appear for instance as fouling of wires and felts, and as breaks.

In fact, in the process for manufacturing paper or board according to the present invention, and especially in the production of the water-based composition which is used in the process, it is essential that the burnt lime or calcium hydroxide is added into an aqueous solution, such as into the fetch water of the chemical pulp, mechanical pulp or recycled fibre pulp of the paper or board production, simultaneously with carbon dioxide, in which case the pH value of the process water is kept at its original level, during the addition of all of these components.

Based on the above, in one embodiment, pressure is used in order to generate carbonate filler from acidic water in the headbox, in the wire, the press and/or the drying sections.

Typically, the carbonate compound which is comprised in the acidic water is mainly calcium carbonate, magnesium carbonate, a composite or a mixture of these. "Mainly" means that at least 50% by weight of the carbonate compounds are calcium or magnesium carbonate or a composite or a mixture of these. However, the composition can also comprise other alkali and alkali earth carbonates, including ammonium compounds.

With regard to the aqueous composition and production, we also refer to what is described in applications FI 20085969, FI 20096098, FI 20105437 and FI 20105627.

When process waters of paper or board machines are treated, according to the present invention, at the factory, a larger amount of useful bicarbonate is generated per unit volume of the aqueous solution than if the calcium carbonate slurries were added into the process waters, because of the equilibrium reaction of the different forms of carbonate. However, the calcium carbonate used in the present invention must be colloidal, with the average particle size of which being preferably smaller than 100 nanometers. As a result of hydration of carbon dioxide in water, bicarbonate reacts with fibre and the charged groups of fines, for instance carboxylic and hydroxyl groups, and possibly affects the generation of hydrogen bonds between these groups and water molecules. The different forms of carbonate ions, which are present in the solutions according to the present invention, affect the width of the "repulsion zone" making it narrower on the surface of different solids of paper or board pulp. In this case, different surface reactions, such as flocculation and coagulation, take place more easily.

In the present invention, it is demonstrated that when the above-mentioned "acidic water", i.e. water-based composition, is used as such for diluting paper or board pulp, and especially when the pH value of the diluted paper or board pulp is raised with an alkali and at the same time, as the solids percentage of the pulp is raised by infiltration, compression and evaporation in the wire, press and drying sections respectively, carbonate filler is precipitated from the water-based composition into the paper or board structure. The precipitated carbonate filler in the paper or carbonate structure has a positive effect on the brightness, opacity, printability (absorption properties of printing ink), thickness and rigidity.

Correspondingly, it is demonstrated that when the above-mentioned "acidic water", i.e. water-based composition, is used for diluting chemical pulp, mechanical pulp or recycled fiber pulp, and especially when, at a later stage of the paper or board production, other charged polymers and/or inorganic chemicals are added into this diluted pulp, it is possible to affect favourably especially the removal of the dissolved and colloidal substance carried in by the mechanical pulp or the recycled fibre pulp from the circulating waters. The other charged polymers and/or inorganic chemicals refer to all other natural or synthetic fibres, which are used in the paper and board production, before the pulp is filtrated, compressed and dried.

Preferably, the pH value of the slush is raised with an alkali to at least 8.3, most suitably to 8.35-10.0, more preferably to approximately 8.4-9.8.

According to an additional application of the present invention in manufacturing paper or board, almost-dry paper or board or similar fibre product is moistened in acidic water, after which its pH value is raised with an alkali, after which it is dried. This can be carried out in such a way that almost-dry paper or board or similar fibre product is moistened in acidic water and then dried. Preferably, the moistening takes place by moistening the paper or board or similar fibre product in a basin which contains acidic water. According to another embodiment, acidic water is applied on at least one surface of the fibre product, preferably on both surfaces, by spraying or atomizing.

Here, "almost-dry paper or board or similar fibre product" means a fibre product, the dry matter percentage of which is at least 40% by weight, especially more than 40% by weight, most suitably approximately 45-75% by weight, of the total weight of the fibre product.

As described above, it is possible to carry out the embodiment for instance in association with surface sizing or as a separate moistening process, for instance before coating the paper.

It should also be noted that it is possible to carry out the described embodiment also by drying the fibre product after the moistening, without raising the pH value.

The following examples describe certain preferred embodiments of the present invention. Their purpose is to illustrate benefits and advantages achieved with the present invention, not to restrict the scope of protection of the present invention.

EXAMPLES

The results below demonstrate that when the pH value of moist paper is raised with an alkali and/or by drying, it is possible to make the carbonate ions, which are in the ionic form, especially bicarbonate ions, react with free calcium ions and generate calcium carbonate particles, which bring structural advantages when they are adhered to the surface of the fibres. The calcium carbonate particles fit between the fibrils and the fibre, keeping the fibrils oriented outwards and bringing opacity, brightness, rigidity and thickness (bulkiness) to the structure of the paper or board. In particular, the calcium carbonate particles in the surface of the paper or board improve the adsorption of printing ink. Probably, part of the precipitated calcium carbonate is inside the lumens of the fibres and the pores. Regarding mechanical pulps, the fines function like the fibrils, bringing structural advantages to the fibre network, because of a smaller quantity of fibrils.

The results shown below also indicate that the soluble carbon dioxide and bicarbonate form a steric barrier to allow dissolving of hydrophobic particles. Probably, soluble calcium ions attach dispersed hydrophobic particles onto the surface of the colloidal-sized calcium carbonate particles of the fibre, especially the smallest calcium carbonate particles, i.e. elementary particles (smaller than 10 nanometers), and onto the surface of the fibre. Probably this is furthered by the bicarbonate affecting the charge of the fibrils of the fibre by pushing the fibrils away from the surface of the fibre and from each other, in which case the adsorption area increases and the hydrophobic particles are more easily adsorbed. The adsorption to the fibrils and the fibre are further facilitated by the use of cationic polymers and inorganic minerals, such as bentonite and talc. The effect of the inorganic particles in increasing the adsorption of hydrophobic particles is based on their ability to increase the hydrophobic adsorption area, whereas the effect of cationic polymers is based on the consequence of increasing the cationic charge.

Example 1

Manufacturing Acidic Water

This example describes the production of the acidic water B and C, which are used in the following examples 2 and 3. The bright surplus product, which is manufactured from the bright wire water of a boxboard machine, is used in example 2 for diluting a high-consistency groundwood pulp. The bright filtrate of a newsprint machine, which uses deinked pulp, is used in example 3 for diluting high-consistency deinked pulp which comes from a deinking plant.

The acidic water for examples 2 and 3 was prepared into the bright surplus product (example 2) of a boxboard machine, which was allowed to sediment for a period of 12 hours, or into the bright filtrate (example 3) of a newsprint machine which uses deinked pulp. Both the bright surplus product and the bright filtrate describe the process waters of a board machine and a newspaper machine. First, 30 kilos of a bright overhead product or a bright filtrate were weighed into a closable plastic canister (capacity 30 liters). 150 grams of burnt lime (CaO) was added into 350 grams of ion-exchanged water having a temperature of 45° C., and simultaneously mixed smoothly. The hydrated lime thus generated was added simultaneously along with carbon dioxide into 30 kilos of bright filtrate or overhead product, while at the same time maintaining a pH value of 6.3. This solution was allowed to sediment for a period of 12 hours, after which the colloidal, unsedimented part was removed from the canister. The sediment on the bottom was not used in the tests. The average particle size of this colloidal substance was 66 nanometers (Malvern nano-ZS) and the dry matter percentage was 0.12 g/l.

When consistent groundwood pulp or deinked pulp was first diluted with the acidic water described above and, after that, the chemicals in table 1 were added into the diluted consistent pulp, a solution was generated, which in the following examples is called acidic water B. When the chemicals in table 1 were added into the acidic water, which was prepared according to the way described above, immediately before the consistent groundwood pulp or the deinked pulp was diluted, acidic water C, in turn, was generated.

Example 2

Production of Groundwood Pulp by Means of Acidic Water $H_2O_2$ bleached groundwood pulp for the middle layer of a boxboard machine, from the storage tower of a board mill, was used in this example. The consistency of the pulp was 10.6% and the freeness reading was 340. The wire water of the boxboard machine was allowed to settle for a period of 12 hours, before the bright overhead product was separated from the sedimented fibre substance. At test point A (A control), the groundwood pulp was diluted with the bright overhead product to a consistency of 2.0%. The pH value of the diluted pulp was raised from approximately 5 to 6.3, with a NaOH solution, and the chemicals in table 3 were added into this 2.0% pulp in a DDJ. At test point B (acidic water B), the groundwood pulp was diluted with acidic water B, which was prepared according to example 1, to a consistency of 2.0% and the chemicals in table 3 were added into this 2.0% pulp in a DDJ. At test point C (acidic water C), the groundwood pulp was diluted with acidic water C, which was prepared according to example 1, to a consistency of 2.0% immediately after the chemicals in table 3 were added into this acidic water C. Consequently, the chemicals in table 3 are added into the acidic water before the pulp is diluted and before the final treatment in a DDJ, at test points C.

Table 1 describes the different test points, in which the chemical doses are expressed as active chemicals, calculated from dry fibre. Four repetitions are carried out at each chemical level, and at each chemical level, all three different pulps are separately treated (A control, acidic water B and acidic water C). The polydadmac (dadmac) used was Zenix DC7429 and the polyamine (amine) used was Zenix DC7479, both sourced from Ashland. The bentonite used was Hydrocol SH, sourced from BASF.

TABLE 1

Test points in example 2.

| GROUNDWOOD PULP | A control kg/t | Acidic water B kg/t | Acidic water C kg/t |
|---|---|---|---|
| dadmac | | | |
| 1 | 0 | 0 | 0 |
| 2 | 0.5 | 0.5 | 0.5 |
| 3 | 1.5 | 1.5 | 1.5 |
| amine | | | |
| 4 | 0.5 | 0.5 | 0.5 |
| 5 | 1.5 | 1.5 | 1.5 |

TABLE 1-continued

Test points in example 2.

| GROUNDWOOD PULP | A control kg/t | Acidic water B kg/t | Acidic water C kg/t |
|---|---|---|---|
| bentonite | | | |
| 6 | 0.5 | 0.5 | 0.5 |
| 7 | 1.5 | 1.5 | 1.5 |

A 300 ml pulp sample having a consistency of 2.0% is mixed in a DDJ (Dynamic Drainage Jar) at 1000 rpm for a period of two minutes, according to table 1, either without any added chemical or with an amount of chemical added into the DDJ, according to table 1. After that, a base valve in the DDJ is opened, and a 100 ml sample is collected through a 100-mesh metal wire.

In the case of this groundwood pulp, the hydrophobic particles are resin. The number and size of hydrophobic particles in the 100 milliliter samples which are treated as described above are analysed with a flow cytometer. The samples are numbered A1-A7, B1-B7 and C1-C7, according to table 1. All the samples were carefully mixed and diluted with ion-exchanged and filtered water (0.2 μm) to 1:50 before the analysis. 1 ml of diluted sample was dyed with 20 μl of Nile Red solution approximately one minute before analysis (Nile Red solution=10 μg/ml in methanol). The samples were mixed with a vibro-mixer and analysed with a Partec CyFlo SL Blue flow cytometer. The trigger channel used was a forward scattering detector.

The hydrophobic particles were separated from the other particles, according to the "gate" in FIG. 1.

The turbidity is measured with a standard turbidity meter, which shows the turbidity in FTU units. The charge of the filtrate is determined by titrating with a PCD device from Mitek.

The acquired turbidity, colloidal charge and number of hydrophobic particles in millions are shown in table 2.

TABLE 2

The results in example 2.

| GROUNDWOOD PULP | Hydrophobic particles/ml × $10^6$ | Turbidity, FTU | Colloidal charge, μeq/l |
|---|---|---|---|
| A1 | 19.8 | 1070 | −352 |
| A2 | 7.1 | 810 | −200 |
| A3 | 5.5 | 460 | −175 |
| A4 | 10.8 | 780 | −215 |
| A5 | 3.6 | 250 | −110 |
| A6 | 14.1 | 860 | −290 |
| A7 | 12.4 | 810 | −270 |
| B1 | 12.6 | 720 | −290 |
| B2 | 5.0 | 525 | −165 |
| B3 | 4.2 | 315 | −140 |
| B4 | 4.8 | 500 | −170 |
| B5 | 3.8 | 270 | −130 |
| B6 | 6.1 | 590 | −190 |
| B7 | 6.3 | 550 | −180 |
| C1 | 12.6 | 615 | −286 |
| C2 | 3.8 | 505 | −145 |
| C3 | 5.2 | 290 | −125 |
| C4 | 4.1 | 480 | −150 |
| C5 | 2.7 | 210 | −80 |
| C6 | 5.7 | 610 | −230 |
| C7 | 5.3 | 620 | −210 |

The results obtained are also shown in the accompanying figures (FIGS. 2-6).

Figure 2:
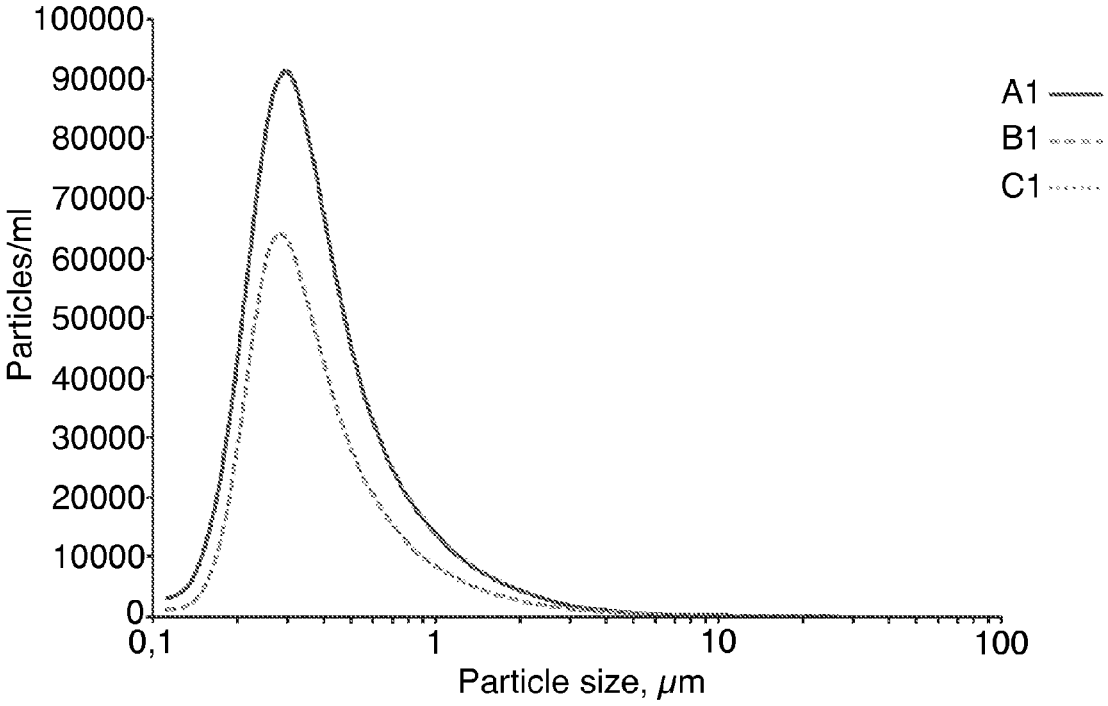
FIG. 2 is a graph which illustrates the effect of untreated water (A control) and acidic waters B and C on the size distribution and the number of the resin particles.

FIG. 2 clearly shows that the number of resin particles decreases considerably only when the consistent (10.6%) pulp is diluted with acidic water. This means that the acidic water itself has an effect which increases the adhesion of hydrophobic particles onto the fibre. Beyond that, no agglomeration of resin particles can be observed.

Figure 3:
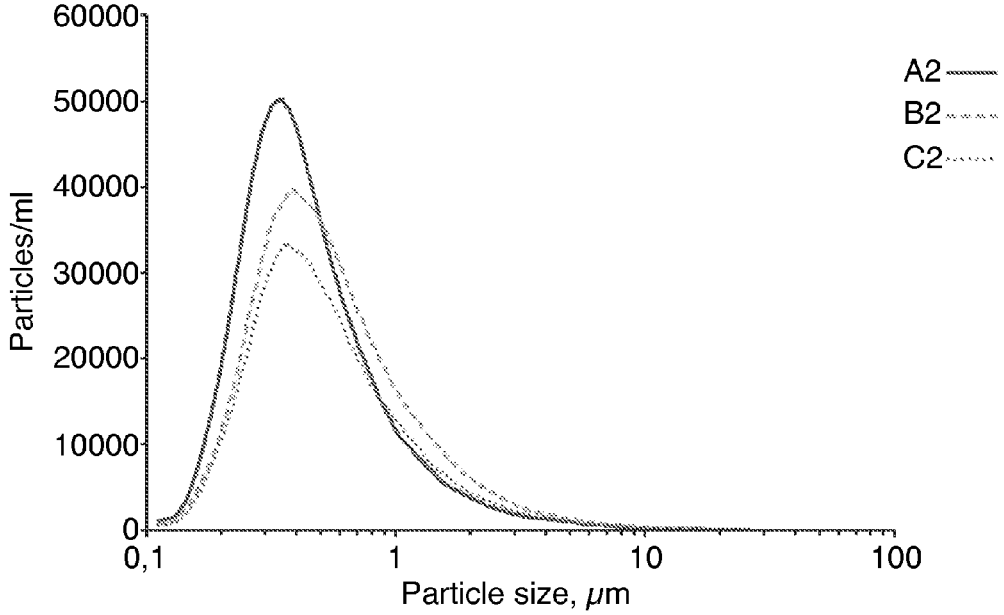
FIG. 3 is a graph which illustrates the size distribution and the number of the resin particles, when 0.5 kg polydadmac/tonne is used at test points A2, B2 and C2.
Figure 4:
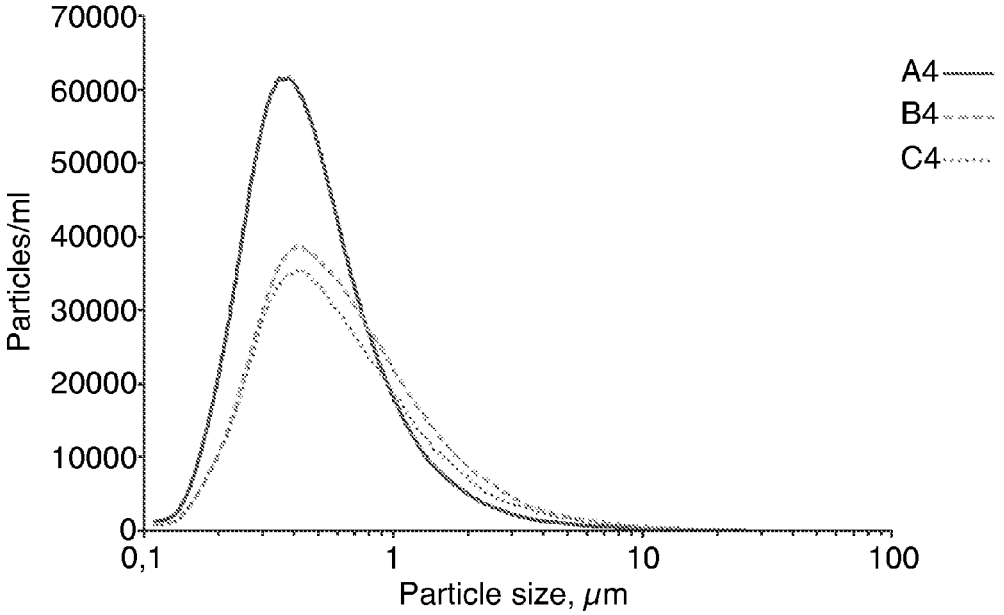
FIG. 4 is a graph which illustrates the size distribution and the number of the resin particles, when 0.5 kg polyamine/tonne is used at test points A4, B4 and C4.

FIG. 3 shows that addition of polydadmac into acidic water immediately before dilution of the consistent pulp gives the best result with regard to attaching resin particles onto the fibre (C2). If the consistent pulp is diluted with acidic water and, after that, 0.5 kg polydadmac/tonne is added into the diluted pulp, agglomeration (B2) of resin particles is observed, and not even the total number of the resin particles adhered onto the fibres is as large as when polydadmac is dosed into acidic water before dilution of the consistent groundwood pulp.

When 0.5 kg polyamine/tonne (see FIG. 4) is dosed, some agglomeration is observed in both addition orders (B4 and C4) of acidic water and polyamine. In this case, too, the best way of attaching resin to the fibre is to add polyamine into acidic water immediately before dilution of the consistent pulp.

Figure 5:
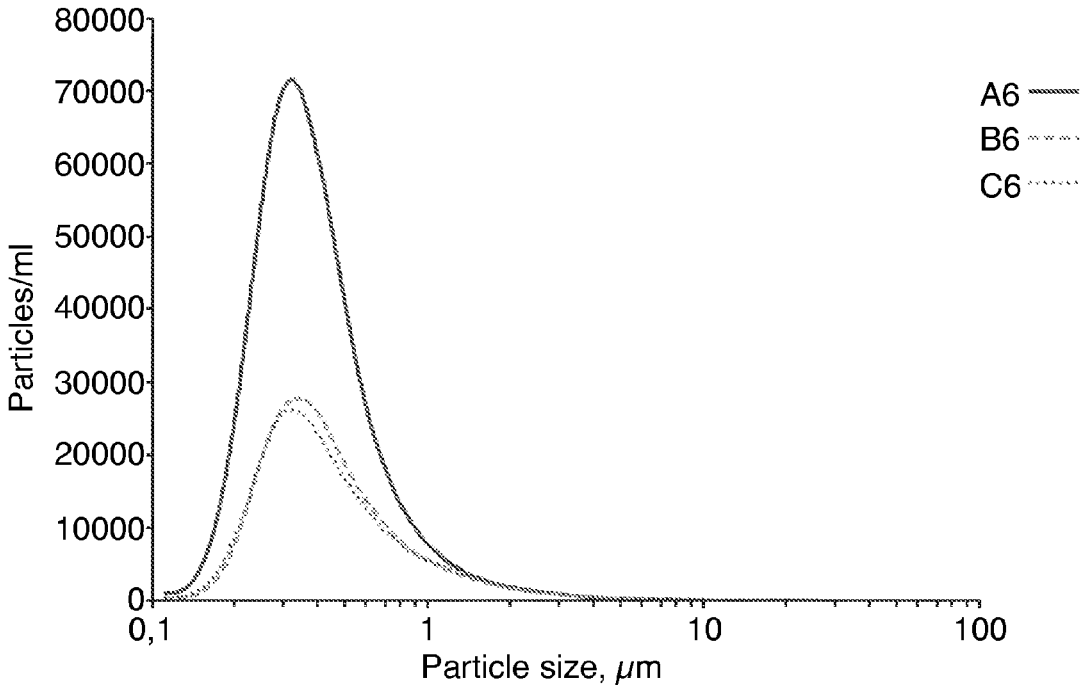
FIG. 5 is a graph which illustrates the size distribution and the number of the resin particles, when 0.5 kg bentonite/tonne is used at test points A6, B6 and C6.

FIG. 5 shows the effect of 0.5 kg bentonite/tonne on adhering resin onto the fibre. Here, the combined effect of the chemical added (bentonite) and the acidic water is greatest. Without acidic water, this bentonite dosage causes a decrease in the total number of resin particles, according to table 2, from 19.8 million to 14.1 million particles per milliliter. When using acidic waters (B6 and C6), the result is approximately 6 million resin particles per milliliter. Again, the most effective way is to add bentonite into water before dilution.

Figure 6:
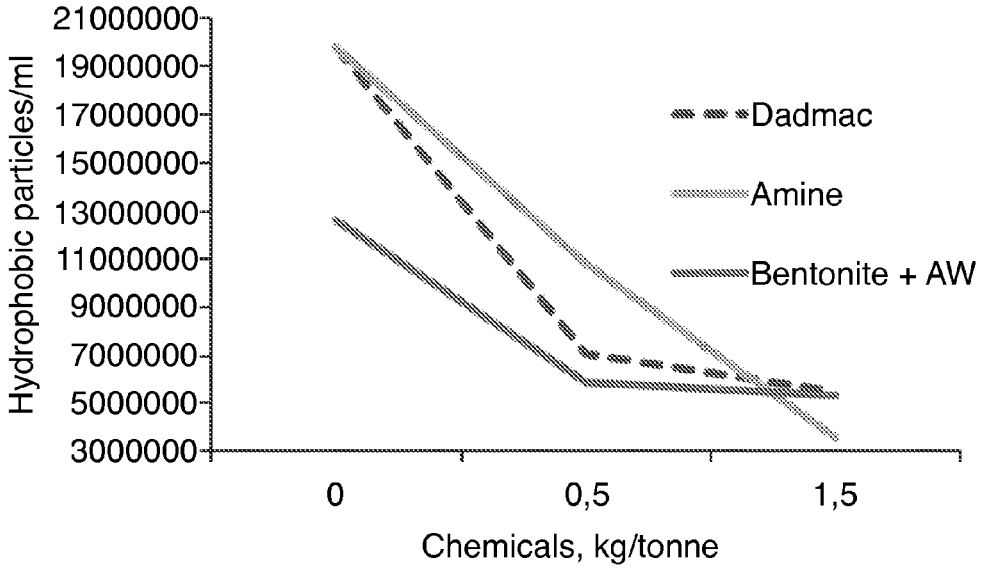
FIG. 6 is a graph which illustrates the number of the resin particles as a function of the quantity of chemical, when the polydadmac test points (test points A1, A2 and A3) and the polyamine test points (A1, A4 and A5) are compared with the bentonite test points (C1, C6 and C7), at all of which 0.5 kg of active chemical/tonne has been added.

FIG. 6 shows that when acidic water (AW) is used, into which bentonite is added immediately before dilution, a better level of adhesion of the resin particles is achieved with a dosage of 0.5 kg/tonne, and with a dosage of 1.5 kg/tonne, approximately the same level is achieved as with the same dosage of polydadmac or polyamine. In this case, there is no acidic water (AW) at the polydadmac and polyamide test points. However, what makes it interesting is that a combination of bentonite and acidic water (bentonite+AW) is substantially more cost effective to use in paper or board production.

Example 3

Manufacturing Deinked Pulp by Means of Acidic Water

In this example, the deinked pulp used is sourced from a high-consistency pulp storage tower of a newsprint mill using deinked pulp. The consistency of the pulp was 11.9% and the freeness reading was 85. Bright filtrate from the newsprint machine was used to dilute the pulp, or, according to example 1, to prepare the acidic water B and acidic water C. At test point A (A control), the deinked pulp was diluted with the bright filtrate to a consistency of 2.0%. The pH value of the diluted pulp was raised from approximately 4.8 to 6.3 using a 10% NaOH solution, and the chemicals in table 3 were added into this 2.0% pulp in a DDJ. At test point B (acidic water B), the deinked pulp was diluted with the acidic water B, which was prepared, according to example 1, to a consistency of 2.0%, and the chemicals in table 3 were added into this 2.0% pulp in a DDJ. At test point C (acidic water C), the deinked pulp was diluted with the acidic water C which was prepared, according to example 1, to a consistency of 2.0% immediately after the chemicals in table 3 were added into this acidic water C. Consequently, the chemicals in table 3 are added into the acidic water before dilution and a final treatment of the pulp in a DDJ, at test points C.

Table 3 shows the different test points, at which the chemical doses are expressed as active chemicals, calculated from dry fibre. Four repetitions are carried out at each chemical level, and at each chemical level, all three different pulps are separately treated (A control, acidic water B and acidic water C). The polydadmac (dadmac) used was Zenix DC7429 and the polyamine (amine) used was Zenix DC7479, sourced from Ashland. The bentonite used was Hydrocol SH, sourced from BASF.

TABLE 3

Test points in example 3.

| DEINKED | A control kg/t | acidic water B kg/t | acidic water C kg/t |
|---|---|---|---|
| dadmac | | | |
| 1 | 0 | 0 | 0 |
| 2 | 0.5 | 0.5 | 0.5 |
| 3 | 1.5 | 1.5 | 1.5 |
| amine | | | |
| 4 | 0.5 | 0.5 | 0.5 |
| 5 | 1.5 | 1.5 | 1.5 |
| bentonite | | | |
| 6 | 0.5 | 0.5 | 0.5 |
| 7 | 1.5 | 1.5 | 1.5 |

A 300 ml pulp sample having a consistency of 2.0% is mixed in a DDJ (Dynamic Drainage Jar) at 1000 rpm for a period of two minutes, according to table 3, either without any added chemical or with an amount of chemical added into the DDJ, according to table 3. After that, a base valve in the DDJ is opened, and a 100 milliliter sample is collected through a 100-mesh metal wire.

The number and size of hydrophobic particles in the 100 milliliter samples which are treated as described above are analysed with a flow cytometer. The samples are numbered A1-A7, B1-B7 and C1-C7, according to table 3. All the samples were carefully mixed and diluted with ion-exchanged and filtered water (0.2 μm) to 1:50 before the analysis. 1 ml of diluted sample was dyed with 20 μl of Nile Red solution approximately one minute before analysis (Nile Red solution=10 μg/ml in methanol). The samples were mixed with a vibro-mixer and analysed with a Partec CyFlo SL Blue flow cytometer. The trigger channel used was a forward scattering detector.

Detailed instructions of the principles of operation and applications of the flow cytometer for paper or board pulps can are found in the doctoral thesis of Lari Vähäsalo, "White pitch deposition—mechanisms and measuring techniques", Laboratory of Wood and Paper Chemistry, Department of Chemical Engineering, Åbo Akademi University, Finland, 2005.

The turbidity is measured using a standard turbidity meter, which shows the turbidity in FTU units. The charge of the filtrate is determined by titrating with a PCD device from MÜTEK.

The acquired turbidity, colloidal charge and number of hydrophobic particles in millions are shown in table 4.

TABLE 4

Results in example 3.

| DEINKED | Hydrophobic particles #/ml × $10^6$ | Turbidity, FTU | Colloidal charge, μeq/l |
|---|---|---|---|
| A1 | 32.4 | 2450 | −103 |
| A2 | 20.5 | 460 | −45 |

TABLE 4-continued

Results in example 3.

| DEINKED | Hydrophobic particles #/ml × $10^6$ | Turbidity, FTU | Colloidal charge, μeq/l |
|---|---|---|---|
| A3 | 8.8 | 106 | −37 |
| A4 | 22.1 | 246 | −44 |
| A5 | 6.6 | 62 | −29 |
| A6 | 25.8 | 1060 | −86 |
| A7 | 24.3 | 462 | −63 |
| B1 | 19.7 | 1815 | −91 |
| B2 | 12.6 | 215 | −32 |
| B3 | 5.2 | 77 | −30 |
| B4 | 10.7 | 187 | −32 |
| B5 | 4.4 | 43 | −25 |
| B6 | 11.4 | 260 | −62 |
| B7 | 8.3 | 244 | −56 |
| C1 | 19.7 | 1780 | −86 |
| C2 | 8.4 | 204 | −30 |
| C3 | 4.4 | 52 | −28 |
| C4 | 8.3 | 166 | −29 |
| C5 | 3.2 | 35 | −21 |
| C6 | 7.6 | 235 | −67 |
| C7 | 3.6 | 252 | −57 |

Figure 7:
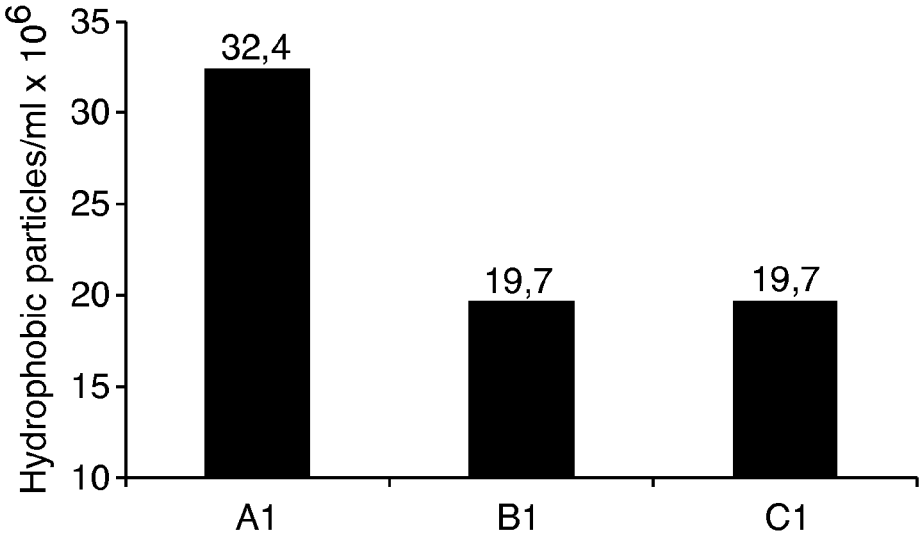
FIG. 7 is a graph which illustrates the number of hydrophobic particles at test points A1, B1 and C1.
Figure 8:
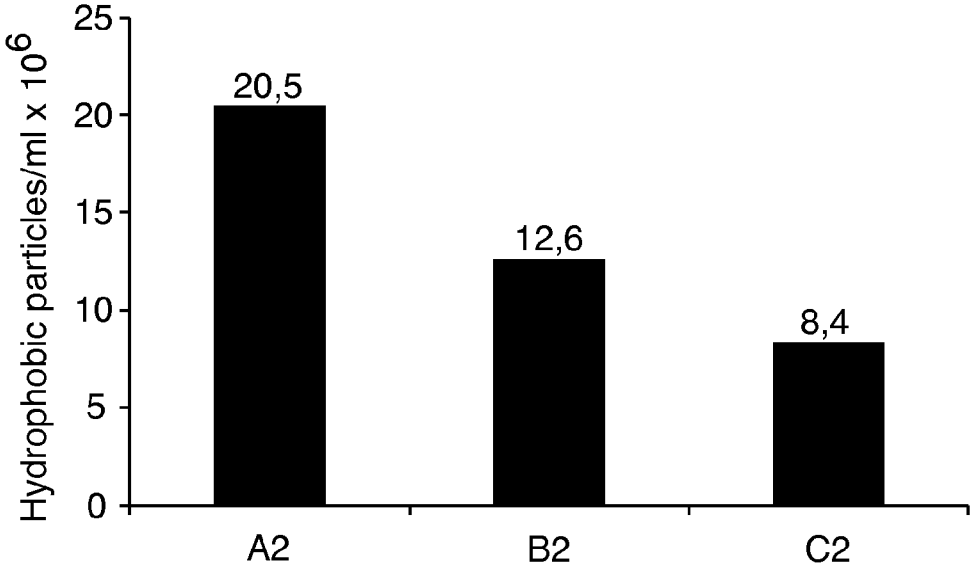
FIG. 8 is a graph which illustrates the number of hydrophobic particles at test points A2, B2 and C2.

The results obtained are also shown in the accompanying figures (FIGS. 7-9).

FIG. 7 shows that acidic water is able to attach hydrophobic particles to the fibre.

FIG. 8 shows that it is most advantageous to add 0.5 kg polydadamac/tonne into acidic water immediately before the consistent pulp is diluted, in which case a maximum number of hydrophobic particles can be attached to the fibre.

Figure 9A:
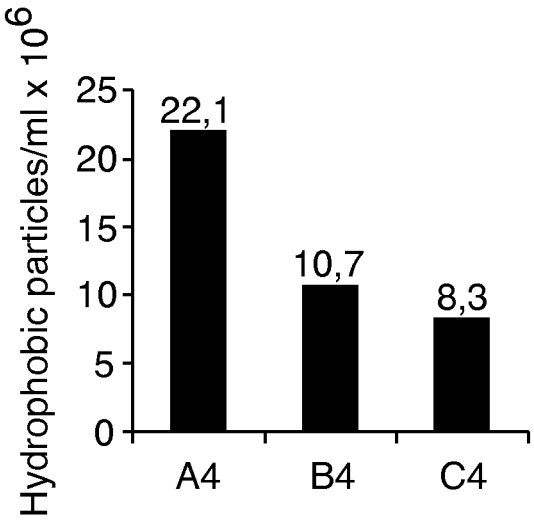
FIG. 9 is a graph which illustrates the number of hydrophobic particles at test points A4, B4 and C4 (FIG. 9A) and the number of hydrophobic particles at test points A6, B6 and C6 (FIG. 9B).
Figure 9B:
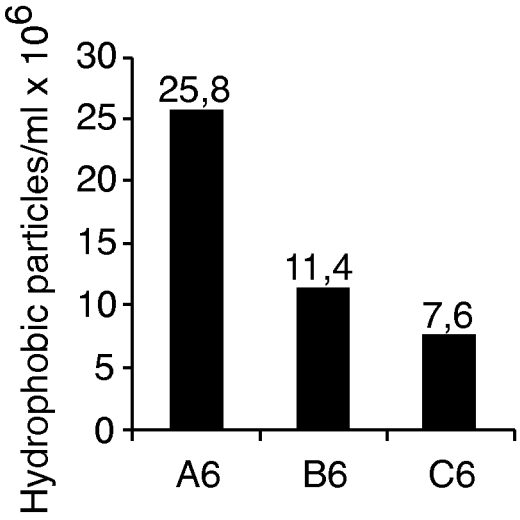

FIG. 9 shows that both 0.5 kg polyamine/tonne (FIG. 9A) and 0.5 kg bentonite/tonne (FIG. 9B) generate the best adhesion of hydrophobic particles to the fibre when the chemical to be added is added into the acidic water immediately before the dilution of the consistent pulp (see C4 and C6).

Example 4

The Effect of Raising the pH Value and/or Drying on the Properties of Wet Paper or Board In this series of tests, a mixture of bleached tall pulp and bleached birch pulp was first refined in a Valley grinder to SR number 30. 30% of the weight of the pulp is tall pulp and 70% is birch pulp. The refining of the pulp is carried out according to the standard method SCAN-C 25:76. This pulp was diluted with acidic water (AW), according to the present invention, to a consistency of 0.2%, before the sheets were manufactured. In addition, in order to compare the results, slushes were prepared by diluting them to 0.2% with ion-exchange water, to which slushes precipitated calcium carbonate (FS-240, Shaefer Finland Oy), which was precipitated to 0, 20 or 40% calculated from dry fibre, was added. The scalenohedral PCC, which was used at these reference test points (A, B and C), was Precarb FS-240 (Schaefer Finland Oy).

The acidic water (AW) was prepared into ion-exchanged water. First, 25 kilos of ion-exchanged water were weighed into two closable plastic canisters (volume 30 liters). 170 grams of burnt lime (CaO) was added into this, which was slaked before the addition into 600 grams of ion-exchanged water having a temperature of 45° C. By adding carbon dioxide into this dilute calcium hydroxide sludge, $Ca(OH)_2$, the pH value was lowered from approximately 12 to 6.3. This solution was allowed to sediment for a period of 12 hours, after which the colloidal, unsedimented part was removed from the canister. The sediment on the bottom was not used in the tests. These waters comprising ions of carbonate and of calcium were used as dilution water when the refined cellulose pulp was diluted to a consistency of 0.2%.

From the pulps prepared in this way, which have a consistency of 0.2%, 80 g/$m^2$ sheets were manufactured in a sheet mould, without using circulation water, according to the standard SCAN-C 26:76 (SCAN-M 5:76). 10 sheets were manufactured from each test point by using cationic polyacrylamide (Praestaret PK 435) as retention agents. 250 g polyacrylamide/tonne were added by mixing without shear forces. After that, the sheets were wet pressed and dried in a drum dryer (120° C., 2 hours), as described in the publication of Pertti Aaltonen: Methods of Testing Fibre Raw Material and Paper, Otakustantamo, Finland, 1986. Some of the sheets were allowed to dry for a period of 72 hours at a temperature of 23° C., and some were not wet-pressed. The different test points and the treatments at those points are described in Table 5. All the manufactured sheets were taken to be conditioned for a period of 48 hours at a temperature of 23° C. and at a relative humidity of 50%. After that, the grammages of the sheets were checked and the following properties were determined:

percentage of filler (575° C. and 2 hours)

ISO brighness (L&W Elrepho Spectrophotometer SE070), ISO 2470

Opacity (L&W Elrepho Spectrophotometer SE070), ISO 2471

Rigidity (L&W paper bending tester SE160), ISO 2493/SCAN-P 29:95

Thickness (L&W Thickness tester SE51), ISO 534

At an accuracy of ±0.8 g/$m^2$, the grammages of the sheets fulfilled the target grammage of 80 g/$m^2$.

In this test, the assessment of the printability properties of the sheets was determined by measuring the optical density. The sheets were printed using a Universal Testprinter (Testprint B.V.) by using coldset black (Sun Chemical, viscosity 7.3 Pas) using 10 milligrams of ink on the wire side of the sheet. The optical densities were measured with a densitometer (Macbeth) from conditioned and dried samples 24 hours after printing. A pressure of 630 N and a speed of 1 m/s were used in the Universal Testprinter.

The test points and the treatments of the sheets are described in Table 5 below. AW (acidic water) means the water which is used, according to the present invention, as dilution water in sheet production. The sheets of test point D are dried at room temperature (23° C.) for a period of 72 hours. The dilutions of test points A, B and C, and the sheet preparations are prepared into ion-exchanged water.

TABLE 5

Treatment alternatives of the manufactured sheets, before conditioning and testing

| Test point | Explanation | pH rise (0.5% NaOH) | Wet compression | Drum drying |
|---|---|---|---|---|
| A | 0% PCC | NO | YES | YES |
| B | 20% PCC | NO | YES | YES |
| C | 40% PCC | NO | YES | YES |
| D | AW and NaOH | YES | YES | NO |
| E | AW and drum drying | NO | NO | YES |
| F | AW and NaOH and drum drying | YES | YES | YES |
| G | AW | NO | YES | YES |

Depending on the percentage of filler (575° C. and 2 hours), which is determined from the sheets, the results are linearly normalised to the same percentage of filler (in this case to 1.9, 8.2, 10.1 and 1.5%) in Tables 6, 7, 8 and 9. These normalizings are made according to the results of the reference test points A, B and C. 95% reliability indicates a 95% confidence interval.

TABLE 6

Test point D compared with the control - 1.9% filler in paper

| Test point | Opacity, % | ISO brightness, % | Thickness, μm | Rigidity, μNm | Optical density, 10 g |
|---|---|---|---|---|---|
| D | 84.3 | 82.7 | 178 | 498 | 1.16 |
| Control | 83.7 | 81.9 | 161 | 480 | 1.02 |
| 95% reliability | ±0.4 | ±0.2 | ±2 | ±16 | ±0.06 |

The sheets at test point D, which are manufactured in a sheet mould, are sprayed with a 0.5% NaOH solution, as small-sized drops, and are put between couching sheets before wet pressing. This is followed by drying at room temperature (23° C.) for a period of 72 hours, before conditioning and testing.

TABLE 7

Test point E compared with the control - 8.2% filler in paper

| Test point | Opacity, % | ISO brightness, % | Thickness, μm | Rigidity, μNm | Optical density, 10 g |
|---|---|---|---|---|---|
| E | 87.0 | 85.3 | 206 | 580 | 1.56 |
| Control | 86.4 | 84.1 | 167 | 470 | 1.28 |
| 95% reliability | ±0.4 | ±0.2 | ±2 | ±16 | ±0.06 |

After the paper sheets at test point E are made in the sheet mould, couching sheets are added two on each side of them. Wet pressing is not carried out, instead the sheets are dried in a drum dryer before conditioning and testing.

TABLE 8

Test point F compared with the control - 10.1% filler in paper

| Test point | Opacity, % | ISO brightness, % | Thickness, μm | Rigidity, μNm | Optical density, 10 g |
|---|---|---|---|---|---|
| F | 88.4 | 85.7 | 223 | 670 | 1.64 |
| Control | 87.3 | 84.8 | 168 | 470 | 1.36 |
| 95% reliability | ±0.4 | ±0.2 | ±2 | ±16 | ±0.06 |

The sheets at test point F are sprayed with a 0.5% NaOH solution. After that, the paper sheets, each separately, are placed between couching sheets. The sheets are wet pressed and dried in a drum dryer before conditioning and testing.

TABLE 9

Test point G compared with the control - 1.5% filler in paper

| Test point | Opacity, % | ISO brightness, % | Tickness, μm | Rigidity, μNm | Optical density, 10 g |
|---|---|---|---|---|---|
| G | 84.1 | 82.5 | 176 | 490 | 1.17 |
| Control | 83.4 | 81.7 | 159 | 478 | 1.02 |
| 95% reliability | ±0.4 | ±0.2 | ±2 | ±16 | ±0.06 |

Couching sheets are added on both sides of the paper sheets at test point G. The sheets are wet pressed and dried in a drum dryer before conditioning and testing.

It is possible to noticeably improve brightness, opacity, rigidity, thickness and setting time of printing ink. Higher optical density readings indicate that the printing ink is set onto the surface and has not penetrated through the sheet, which would be seen, among others, in print-through measurements. Increased thickness means increased bulkiness of the paper or board. Calcium carbonate, which is generated by raising the pH value and/or by heating, improves substantially the non-transparency. i.e. the opacity, and the setting of the printing ink, compared with the use of commercial calcium carbonate (scalenohedral PCC), at the same percentage.

Test point G is equivalent to the production technique in FI application 20105437, in which most of the water-based composition (acidic water) is removed in the wet press stage before drum drying. The percentage of filler at test point G is 1.5%, which is very close to the percentage of filler at test point D, 1.9%, which filler it was possible to attach to the fibres by raising the pH value. This shows that, in order to achieve larger quantities of filler, either the wet paper to be dried must be as wet as possible, or for instance the pH value must be raised in order to precipitate the ions to form calcium carbonate onto the fibres, and thereby prevent them from migrating, as ions, away from the paper or board structure.

Example 5

Treatment of Paper with the Acidic Water According to the Present Invention

In this example, a dry and conditioned paper is moistened in acidic water, according to the present invention, after which the moistened sheet is treated with a NaOH solution (0.5%) and drum dried.

The acidic water (AW), the water-based composition, was prepared into ion-exchanged water. First, 25 kilos of ion-exchanged water was weighed into two closable plastic canisters (volume 30 liters). 170 grams of burnt lime (CaO) was added into this, which was slaked before the addition in 600 grams of ion-exchanged water having a temperature of 45° C. By adding carbon dioxide into this dilute calcium hydroxide sludge, $Ca(OH)_2$, the pH value was lowered from approximately 12 to 6.7. This solution was allowed to sediment for a period of 12 hours, after which the colloidal, unsedimented part was removed from the canister. The sediment on the bottom was not used in the tests.

The sheets at test points A and C of example 4 above are used in this test. These sheets were moistened for a period of 10 seconds in the acidic water mentioned above. Couching sheets were added on both sides of the moistened paper sheet. The sheets were drum dried and after conditioning, they were tested. "AW moistened" test point A differs from "AW moistened" test point C because in this case the wire side was sprayed with a 0.5% NaOH solution before drum drying.

TABLE 10

Results of the treatments

| Test point | Filler content, % | Opacity, % | ISO brightness, % | Thickness, μm |
|---|---|---|---|---|
| A | 0.5 | 82.7 | 80.8 | 159 |
| A AW moistened | 2.4 | 83.0 | 82.7 | 162 |
| C | 13.4 | 89.9 | 86.9 | 174 |
| C AW moistened | 14.4 | 90.2 | 87.9 | 179 |

Table 10 shows an increase in the percentage of filler, which increase shows that more calcium carbonate is attached to the paper. This, in turn, is expressed as improved brightness, opacity and thickness in the paper. The 95% confidence intervals are the same as in the preceding example.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A process for manufacturing paper or board from paper or board pulp in a papermaking machine having a headbox, wire section, press section, and drying section, the process comprising: i) diluting the pulp to a defined consistency range with a water-based composition, the water-based composition comprising colloidal carbonate particles and bicarbonates and other carbonate compounds in process water, or a mixture of process water and additional water, at a pH value of less than 8.3, and ii) raising the pH value of the diluted pulp with an alkali substantially simultaneously with increasing the solids content of the pulp, whereby a carbonate filler is precipitated from the water-based composition into the paper or board structure.

2. The process according to claim 1, wherein chemical, mechanical or chemi-mechanical pulp, fibre pulps prepared with alkalis, recycled fibre, deinked fibre, nanocellulose pulp, or a mixture of these pulps, are used.

3. The process according to claim 1, wherein the pulp is diluted with the water-based composition in such a way that the consistency of the pulp is at least 1.5% after the dilution.

4. The process according to claim 1, wherein the pH value is raised with an alkali substantially simultaneously with increasing the solids content of the pulp by filtration, compression and/or evaporation on the wire section, the press section and/or drying section of the paper or board machine.

5. The process according to claim 1, wherein the water-based composition is generated from calcium and/or magnesium ions and forms of carbonate in an aqueous solution in such a way that the pH value of the aqueous solution during the generation remains essentially below 8.3, while the pulp is in the headbox.

6. The process according claim 1, wherein the water-based composition used for diluting the pulp has a content of carbonate compounds which is 0.01%, calculated from the weight of the solids of the pulp to be diluted.

7. The process according to claim 1, wherein the average particle size of the carbonate forms is less than 300 nanometers.

8. The process according to claim 1, wherein the carbonate compound contained by the water-based composition is mainly calcium carbonate, magnesium carbonate, or a composite or mixture thereof.

9. The process according to claim 1, wherein the water-based composition is prepared in such a way that oxide or hydroxy slurry and carbon dioxide are added into a flowing aqueous solution in such a way that substantially no precipitates are formed in the composition used for diluting the paper or board pulp, while the pH value is kept below 8.3.

10. The process according to claim 9, wherein the oxide or hydroxy slurry is calcium oxide, magnesium oxide, calcium hydroxide, magnesium hydroxide or a mixture of some or all of these.

11. The process according to claim 9, wherein the aqueous solution into which the water-based composition is prepared is a flowing and substantially fibre-free process water of a paper or board machine, or a mixture of this process water and additional water.

12. The process according to claim 1, wherein the alkali is sodium hydroxide, sodium bicarbonate, sodium carbonate, calcium hydroxide, potassium hydroxide, alkaline bicarbonate, sodium silicate, potassium silicate or a mixture thereof.

13. The process according to claim 1, wherein pressure is applied to the water-based composition in the headbox, on the wire, press and/or drying sections.

14. The process according to claim 1, wherein a chemical is used in manufacturing the paper or board, selected from flocculants, coagulants, or micro particles, aluminium compounds, beater-sizing glues, surface-sizing glues, colours, starch, optical clarifying agents, natural and synthetic polymers.

15. The process according to claim 1, wherein one or more charged polymers and/or one or more inorganic chemicals and/or one or more different micro-particles are added directly into the process water and/or into the water-based composition which is prepared from this process water, after which dilution of the pulp is carried out with the prepared water-based composition.

16. The process according to claim 15, wherein charged polymer and/or inorganic chemical and/or micro-particles are added into the pulp to be diluted, simultaneously with its dilution with the water-based composition.

17. The process according to claim 15, wherein the charged polymer is a natural polymer, synthetic polymer, copolymer, terpolymer or a mixture of two or more of such polymers, selected from polyacryl amide, polyethylene imine, starch, polydadmac, polyamine, polyethylene oxide, polyvinyl amine, dicyanide amide, a copolymer or terpolymer of any of the above, or a mixture of two or more of such polymers, copolymers and/or terpolymers.

18. The process according to claim 15, wherein the inorganic chemical is talc, sodium montmorillonite, bentonite, saponite, sepiolite, hectorite, smectite, zeolite, amorphous magnesium silicate, alum, aluminium chloride, polyaluminium chloride, sodium aluminate, iron sulphate, iron chloride, polyphosphate, polysulphonate, zirconium salt complex or a mixture of two or more chemicals.

19. The process according to claim 15, wherein the quantity of charged polymers and/or inorganic chemicals is smaller than 20%, calculated from the weight of the solids of the pulp to be diluted.

20. The process according to claim 15, wherein the micro-particles are sols, gels, microgels, silicic acids, polysilicic acids, containing bentonites or silicon dioxide, or a mixture thereof.

21. The process according to claim 1, wherein a water-soluble aluminium-containing compound is added into the pulp, substantially simultaneously with the addition of the charged polymer and/or inorganic chemical and/or micro-particles.

22. The process according to claim 1, wherein essentially no coated broke nor filler has been added into the paper or board pulp.

* * * * *